US007334624B2

(12) United States Patent
Waldman et al.

(10) Patent No.: US 7,334,624 B2
(45) Date of Patent: Feb. 26, 2008

(54) SAFETY GATE

(75) Inventors: Kenneth Waldman, Reading, PA (US); Jerome Drobinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 371 days.

(21) Appl. No.: 10/885,333

(22) Filed: Jul. 6, 2004

(65) Prior Publication Data

US 2005/0028947 A1 Feb. 10, 2005

Related U.S. Application Data

(60) Provisional application No. 60/485,481, filed on Jul. 8, 2003.

(51) Int. Cl.
*E06B 3/92* (2006.01)

(52) U.S. Cl. ..... 160/144; 49/371; 49/380; 49/55; 49/463

(58) Field of Classification Search ..... 160/10, 160/541, 144, 218, 180; 16/86.2, 49, 381, 16/26, 86, 231, 239, 233, 258, 259, 284, 16/281, 285, 286, 292, 299, 321, 326, 327, 16/363, 371; 49/371, 380, 55, 463, 465, 49/57, 502; 292/257, 258, 263, 266, 269, 292/273, 277, 300, 302, 338, 342, 343, 95, 292/121, 126, 96, 97, 100, 106, 107, 194, 292/219, 226, 120, 146, 162, 153
See application file for complete search history.

(56) References Cited

U.S. PATENT DOCUMENTS 452,418 A * 5/1891 Thode ..... 16/72
919,750 A * 4/1909 Neumeister ..... 292/60
1,232,340 A * 7/1917 Lehson ..... 49/386
1,583,842 A * 5/1926 Keene ..... 16/285
2,312,638 A * 3/1943 Gedris ..... 297/333
2,602,684 A * 7/1952 Pinke ..... 403/53
3,148,904 A * 9/1964 Hess ..... 292/66
3,706,164 A * 12/1972 Glause et al. ..... 49/394
3,918,753 A * 11/1975 McCormack et al. ..... 292/216
4,021,063 A * 5/1977 Porter ..... 292/67
4,278,968 A * 7/1981 Arnett et al. ..... 340/686.6
4,920,333 A * 4/1990 Barr et al. ..... 340/542
5,524,944 A * 6/1996 Berg ..... 292/163
5,890,320 A * 4/1999 Andersen ..... 49/465
5,900,815 A * 5/1999 Story ..... 340/548
6,112,461 A * 9/2000 Cheng ..... 49/55
6,119,754 A * 9/2000 Okonsky ..... 160/10
6,446,395 B2 * 9/2002 Rogers ..... 49/463
6,499,254 B2 * 12/2002 Rossman et al. ..... 49/55
6,563,278 B2 * 5/2003 Roman ..... 318/282
6,691,467 B2 * 2/2004 Hincher, Sr. ..... 49/463
6,904,642 B2 * 6/2005 West ..... 16/50
2003/0009945 A1 * 1/2003 Cheng ..... 49/57

* cited by examiner

*Primary Examiner*—Brian E. Glessner
*Assistant Examiner*—Candace L. Bradford
(74) *Attorney, Agent, or Firm*—Volpe and Koenig, P.C.

(57) ABSTRACT

A gate having a latching mechanism which requires two distinctly different unlatching movements which occur in distinctly different directions, but where both of these unlatching movements can be performed with the use of only one hand. In addition, timer/alarm capabilities are provided to emit an alert signal in situations where the gate has been opened and has not been reclosed within a given time interval after the gate was opened. The gate has a self-closing spring assembly arranged within a pivot assembly. All of the above capabilities are obtained through a greatly simplified design which is extremely rugged and provides highly reliable service.

19 Claims, 14 Drawing Sheets

SAFETY GATE

CROSS REFERENCE TO RELATED APPLICATION(S)

This application claims priority from U.S. Provisional Application Ser. No. 60/485,481, filed Jul. 8, 2003 which is incorporated by reference as if fully set forth.

FIELD OF INVENTION

The present invention relates generally to safety gates and more particularly to a safety gates having opening mechanisms which are very difficult for infants and young children to operate and yet relatively easy for older children and adults to operate.

BACKGROUND

There are a number of applications where it is desirable to provide a safety gate for the protection of infants, small children, animals and the like.

It is further conventional to provide such safety gates with the ability to be mounted within a doorway and to provide expandable devices for adjusting the width of the safety gate frame to both accommodate doorways of different widths and to provide a reliable compression fit.

It is also desirable to provide such gates to have the capability of being positioned between a banister post and a wall, for example which is located at a top of a staircase, to prevent infants and small children, as well as small animals and infirm persons, from entering upon the staircase and thereby exposing themselves to potential injury.

It is further desirable to provide a latching mechanism which is extremely difficult, if not impossible, for infants and young children to operate, but may be operated by older children and adults with relative ease in view of the fact that there are many occasions in which the safety gate must be opened at least temporarily for valid and non-threatening purposes.

It is also desirable to provide such safety gates with self-closing capabilities and further to provide an alert condition in cases where the safety gate has not been properly closed and latched.

SUMMARY

The safety gate of the present invention provides the above as well as other advantageous features by way of a latching mechanism which, although requiring two distinctly different operating movements which require movement in distinctly different directions, nevertheless enables both of these unlatching movements to be performed with the use of only one hand which greatly facilitates the closing and especially the opening of the latching mechanism. The safety gate latching mechanism includes a moveable latch in which, when latched, prevents its movement away from a stationary member and further prevents the gate from being moved toward an open position by means of a pair of sidearms which engage opposite sides of a cooperating, stationary latching assembly. However, when the latching lever is unlatched, the latching mechanism, which is slidably mounted on the moveable gate, can be pulled back to release and thereby open the gate. The gate is further provided with a self-closing capability.

In addition, timer/alarm capabilities are provided to emit an alert signal in situations where the gate has been opened and has not been reclosed within a given time interval after the gate was opened.

All of the above capabilities are obtained through a safety gate whose design is nevertheless greatly simplified as compared with present day devices and which is extremely rugged and provides highly reliable service.

BRIEF DESCRIPTION OF THE DRAWING(S)

DETAILED DESCRIPTION OF THE PREFERRED EMBODIMENT(S)

Figure 1:
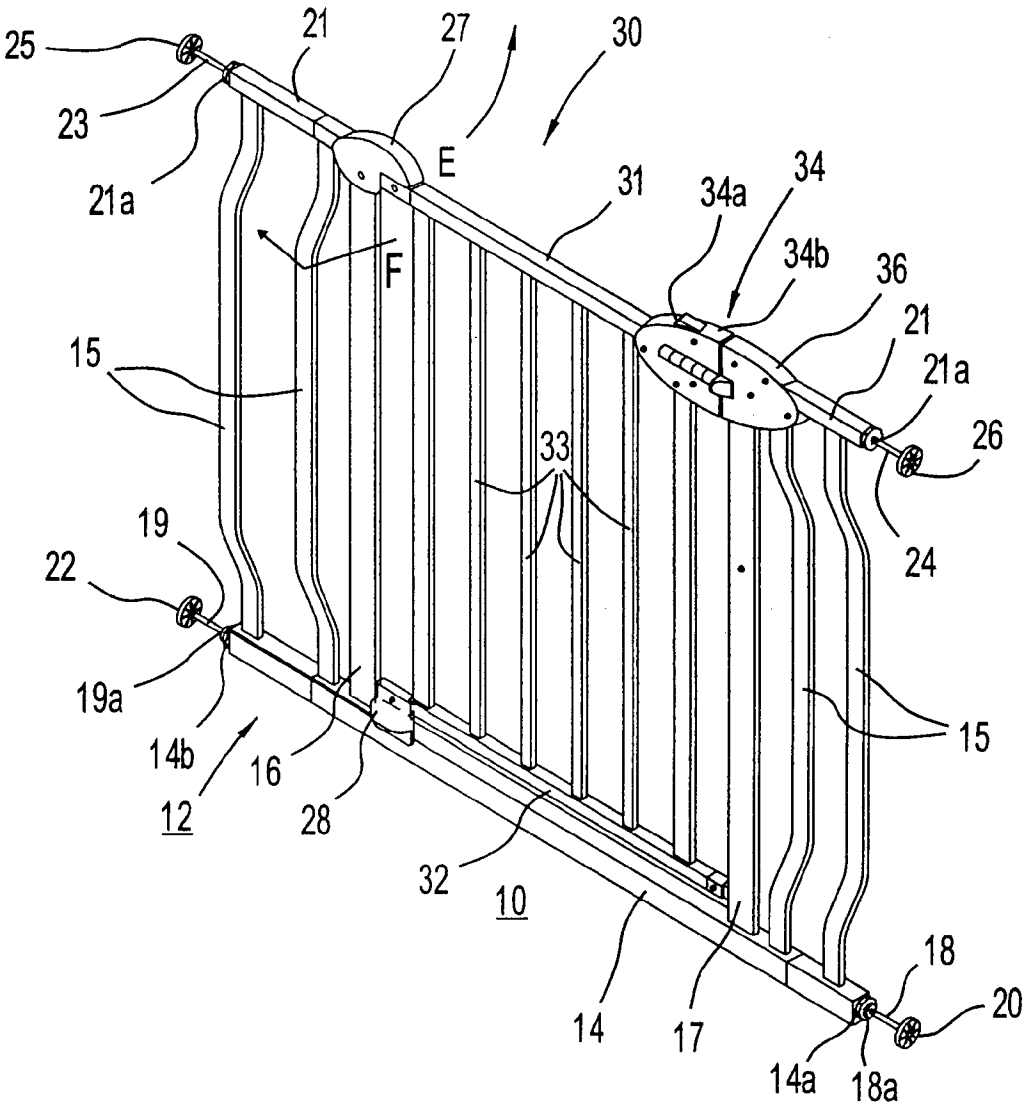
FIG. 1 shows a safety gate in the closed position.
Figure 1A:
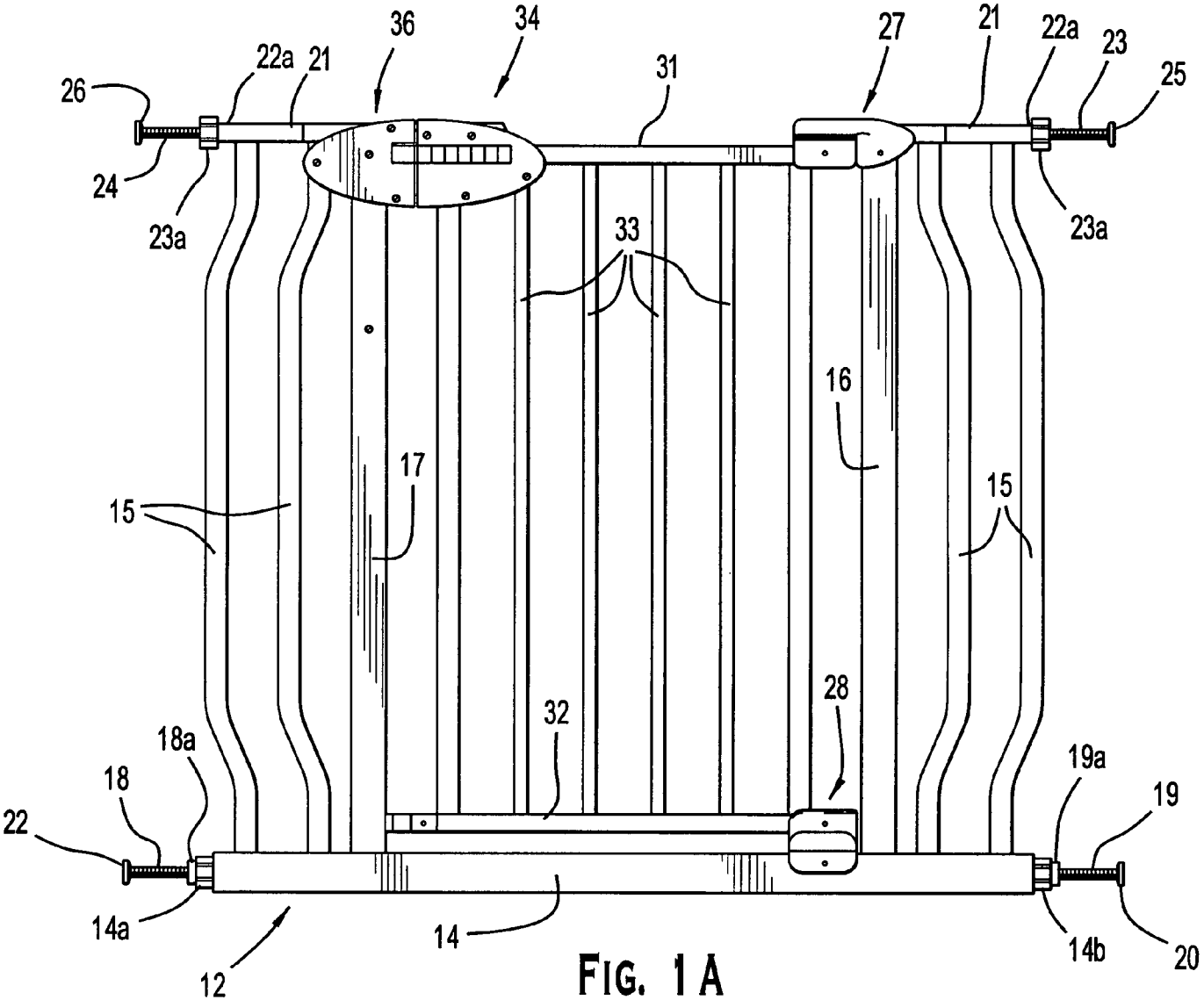
FIG. 1A is an elevation of FIG. 1.
Figure 2:
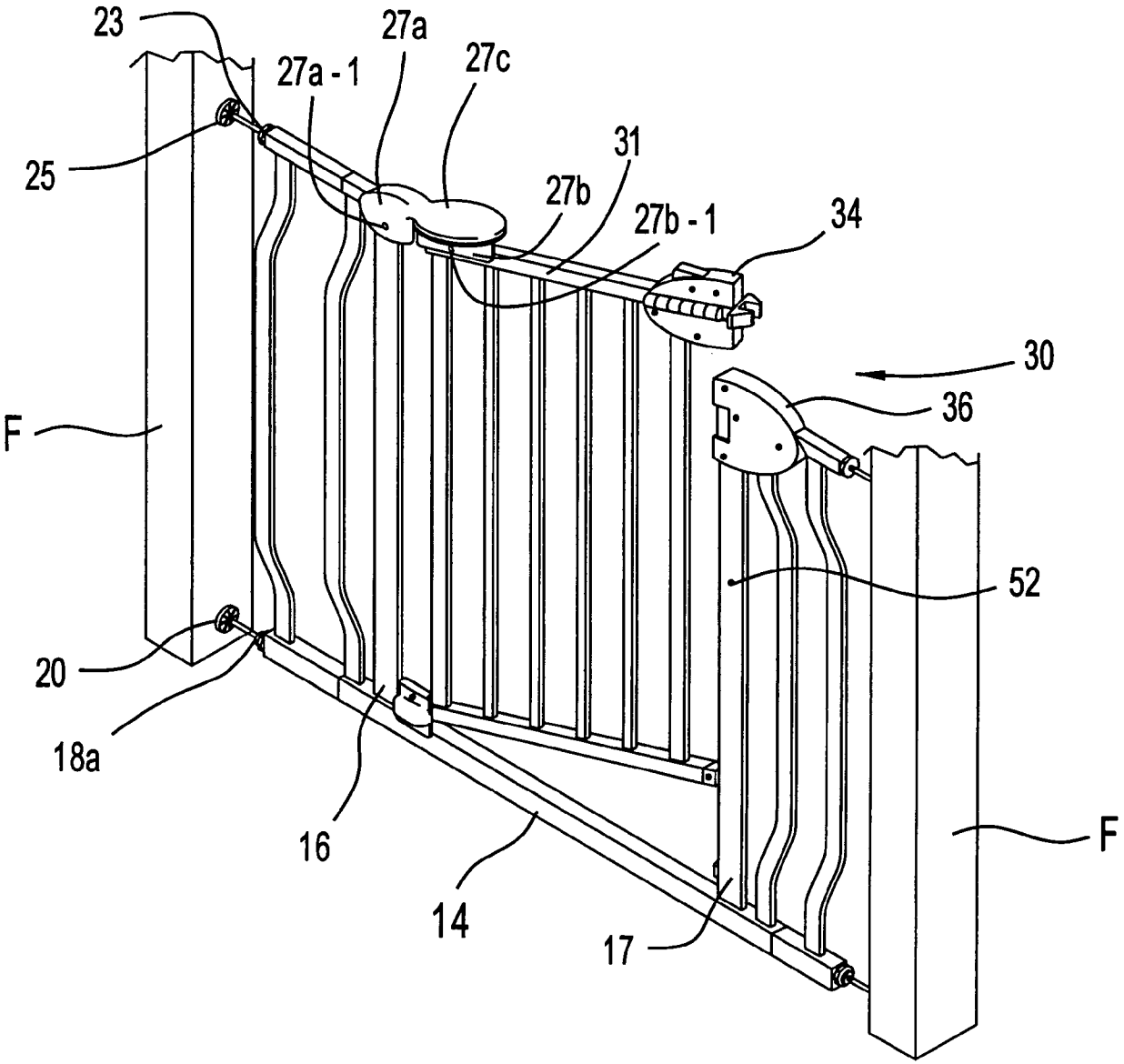
FIG. 2 shows the gate of FIG. 1 in an opening position.

FIGS. 1, 1*a* and 2 show safety gate assembly 10 comprised of a stationary frame 12 having a gate 30 swingably mounted to the frame.

Frame 12 is comprised of an elongated base member 14. A plurality of vertically aligned slats 15 have their lower ends secured to base member 14 near the left and right ends thereof. A post 16 has a lower end secured to base member 14 and is provided for supporting one of the hinge assemblies which pivotally mount swingable gate 30 to frame 12. A second post 17 has a lower end secured to base member 14 and has the stationary latching assembly portion mounted therein, as will be set forth in detail below.

Members 14*a* and 14*b* are inserted into the open ends of base member 14 and are each provided with tapped openings for receiving threaded members 18 and 19. End caps 20 and 22 are mounted on the free ends of threaded members 18 and 19 and preferably have friction surfaces which may be rubber or rubber-like. Threaded members 18 and 19 are rotated to move the end caps 20 and 22 either closer to base member 14 or further away therefrom in order to secure the lower end of the stationary frame within and between the sides of a door frame between two walls (FIG. 2) or between a banister post and a wall located, for example, at a base or top of a stair case. The positions of threaded members are retained by tightening threaded members 18*a* and 19*a* against their respective members 14*a*, 14*b*.

Stationary frame 12 further includes two upper rails 21, 21. The left-hand slats 15 and post 16 have their upper ends secured to one upper rail 21. Similarly, the right-hand slats 15 and post 17 have their upper ends secured to the remaining upper rail 21.

Left-hand threaded member 21*a* is inserted into the left-hand end of the left-hand rail 21 and is provided with a threaded opening which threadedly engages threaded member 23. An end cap 25 is fitted to the free end of threaded member 23. Similarly, right-hand member 21*a* is inserted into the right-hand end of right-hand rail 21 and is provided with a threaded opening threadedly engaging threaded member 24 whose free end is fitted with end cap 26. By rotation of the threaded members 23 and 24 in the appropriate direction, the end caps 25 and 26 are moved either closer toward or further away from their associated rail members 21, 21 to secure the upper end of the stationary frame within the opposing sides of a door frame, for example. The tightening members 21*a*, 21*a* operate in a manner similar to the tightening members 18*a*, 19*a* described above. Thus, members 20, 22, 25, and 26 adjust to accommodate entrance areas of different widths so as to secure the frame 12 thereto by means of a press-fit.

Hinge assemblies 27 and 28 swingably mount the gate 30 to frame 12. More particularly, assembly 27 swingably supports the left-hand end of gate upper rail 31 and assembly 28 swingably supports the left-hand end of the lower rail 32 of gate 30. Rails 31 and 32 are maintained in spaced parallel fashion by the slats 33, which have their upper ends secured to upper rail 31 and their lower ends secured to lower rail 32. Each of the assemblies 27 and 28 houses a suitable hinge assembly as well as a spring member which automatically biases the gate 30 to the closed position from the open position in the event that the gate 30 is accidentally left in the open position.

Hinge assemblies 27, 28 are shown in greater detail in FIGS. 2, 3 and 7A-7C. The upper hinge assembly 27 is comprised of a stationary portion 27*a* which is secured to post 16 by fastener 27*a*-1. Two (2) side walls 27*a*-2, 27*a*-3 of portion 27*a* lie on opposite sides of the rail. A cooperating hinge portion 27*b* is secured to the upper rail 31 of gate 30 by fastener 27*b*-1. The hinge halves 27*a* and 27*b* are pivotally coupled to one another by a vertically aligned pivot pin 27*c*.

The lower hinge assembly 28 is comprised of a stationary portion 28*a* secured to member 14 of the stationary frame 12 by fastener 28*a*-1. The upper half 28*b* of the lower hinge assembly is secured to the lower rail 32 of gate 30 by fastener 28*b*-1. A vertically aligned pivot pin (not shown) couples assembly halves 28*a* and 28*b* together and cooperates with the upper pivot assembly 27 to swing gate 30 about a common vertical axis shared by the hinge assemblies 27 and 28.

At least one of the hinge assemblies 27 and 28 has a pair of coil springs CS1 and CS2 arranged in a cup-shaped housing portion 27*a*-4 of assembly 27*a*, for example. One end of each spring rests against a fixed, common interior wall 27*a*-5 integral with cup-shaped housing 27*a*-4. The hinge portion 27*b* comprises a housing 27*b*-1 embracing circular upper rail 31 and integral with an outer wall of a disk-shaped member 27*b*-2 having a cylindrical-shaped interior wall 27*b*-3 shown in FIG. 3 and projecting away from disk-shaped member 27*b*-2. A projection 27*b*-4 extends upwardly from disk-shaped member 27*b*-2 and engages opposite ends of the coil springs CS1, CS2 in the gap region G. Cylindrical-shaped interior walls 27*b*-3 of housing half 27*b* and 27*a*-6 of housing half 27*a* cooperate with the outer wall 27*a*-4 of housing 27*a* and thereby serve to retain the coil springs in a curved configuration within a toroidal-shaped hollow space. Cylindrical wall 27*b*-3 on the interior side of disk-shaped member 27*b*-1, shown in FIG. 7B, telescopes into cylindrical wall 27*a*-6 to serve as a pivot assembly. When the gate is moved to one side to be opened, one of the springs is compressed between projections 27*a*-5 and 27*b*-4. When the gate is released, the compressed spring returns to its uncompressed state urging projection 27*b*-4 to move the gate toward the closed position. Either the upper or lower or both hinge assemblies may be provided with this type of self-closing spring assembly. As an alternative arrangement, one spring may replace the two springs CS1, CS2, wherein one of the projections is inserted between two adjacent helical turns of the spring.

Figure 4:
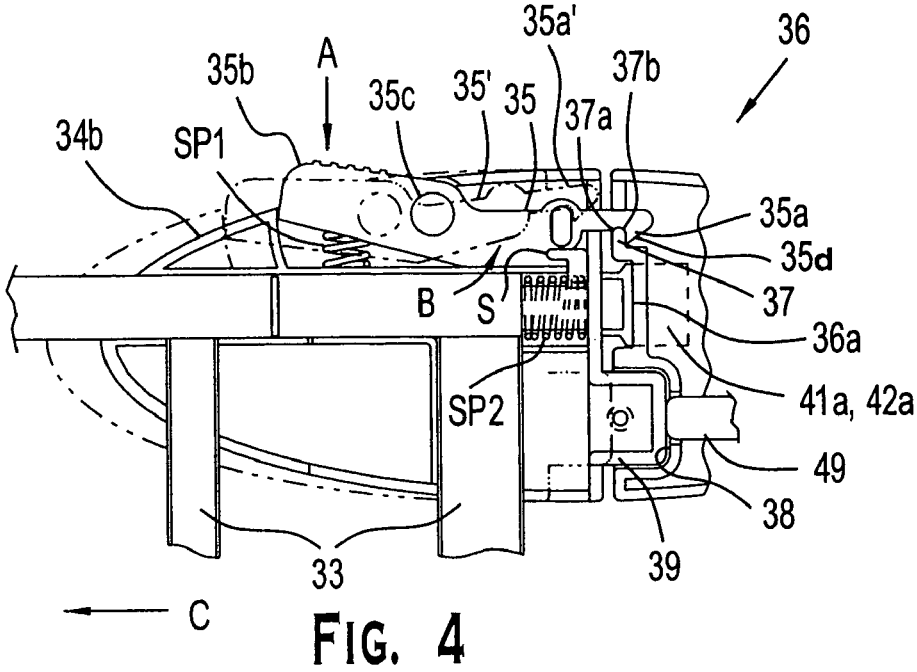
FIG. 4 is a simplified elevational view showing the details of the latch mechanism of FIG. 1, for example.
Figure 8:
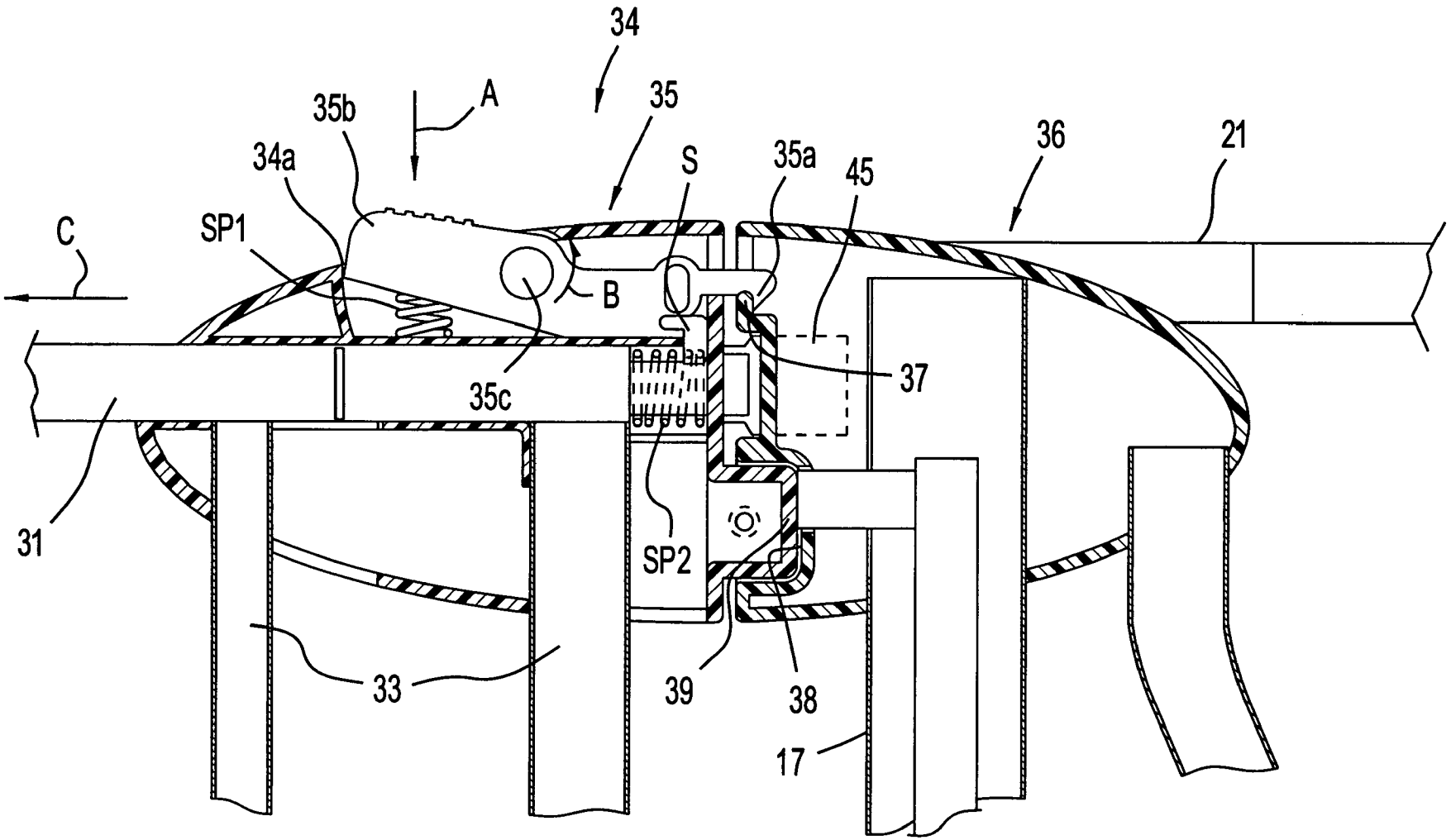
FIG. 8 is a sectional view of a latching mechanism.
Figure 8A:
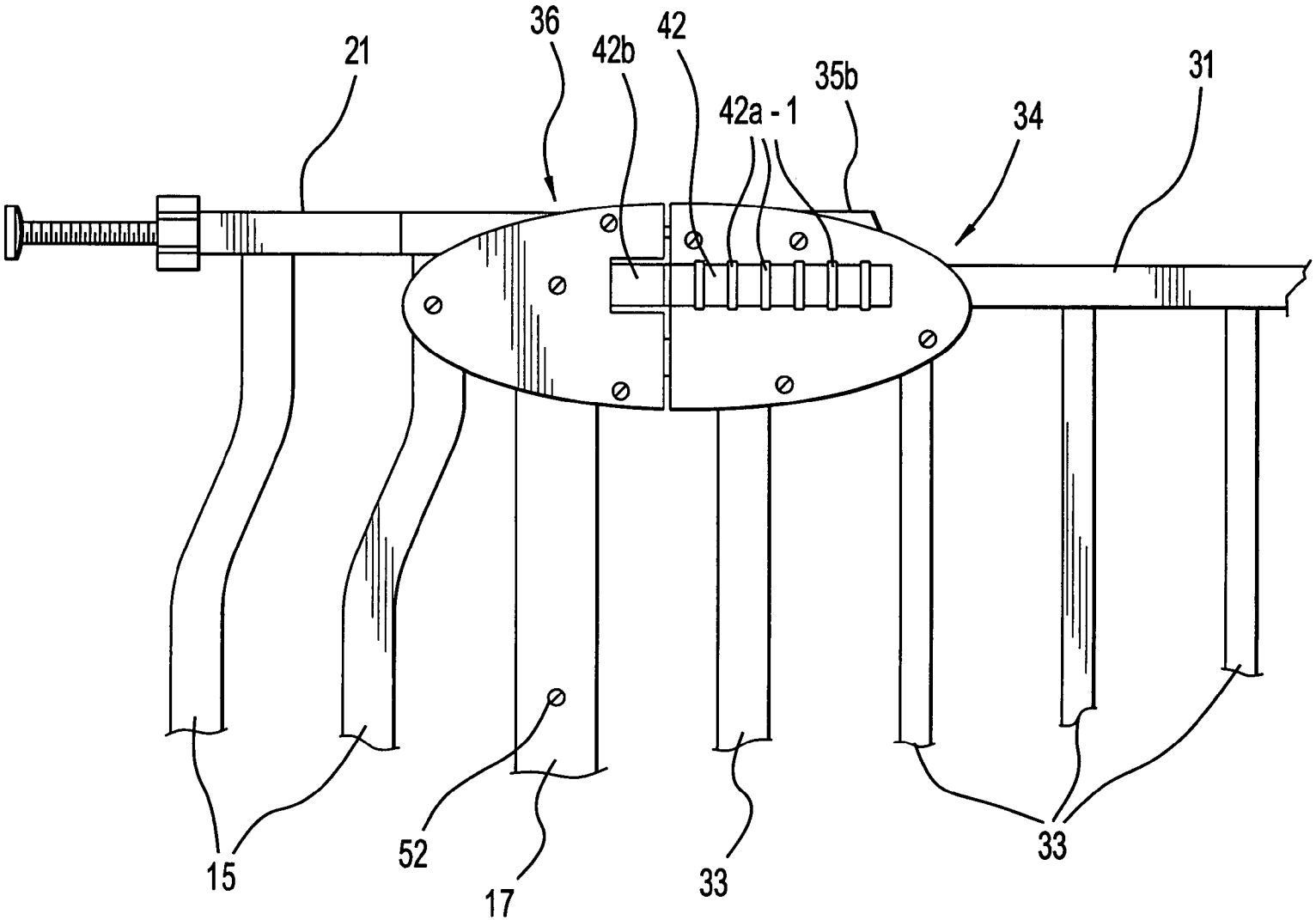
FIG. 8A is an elevational view of the latch mechanism of FIG. 8.
Figures 8B, 8C:
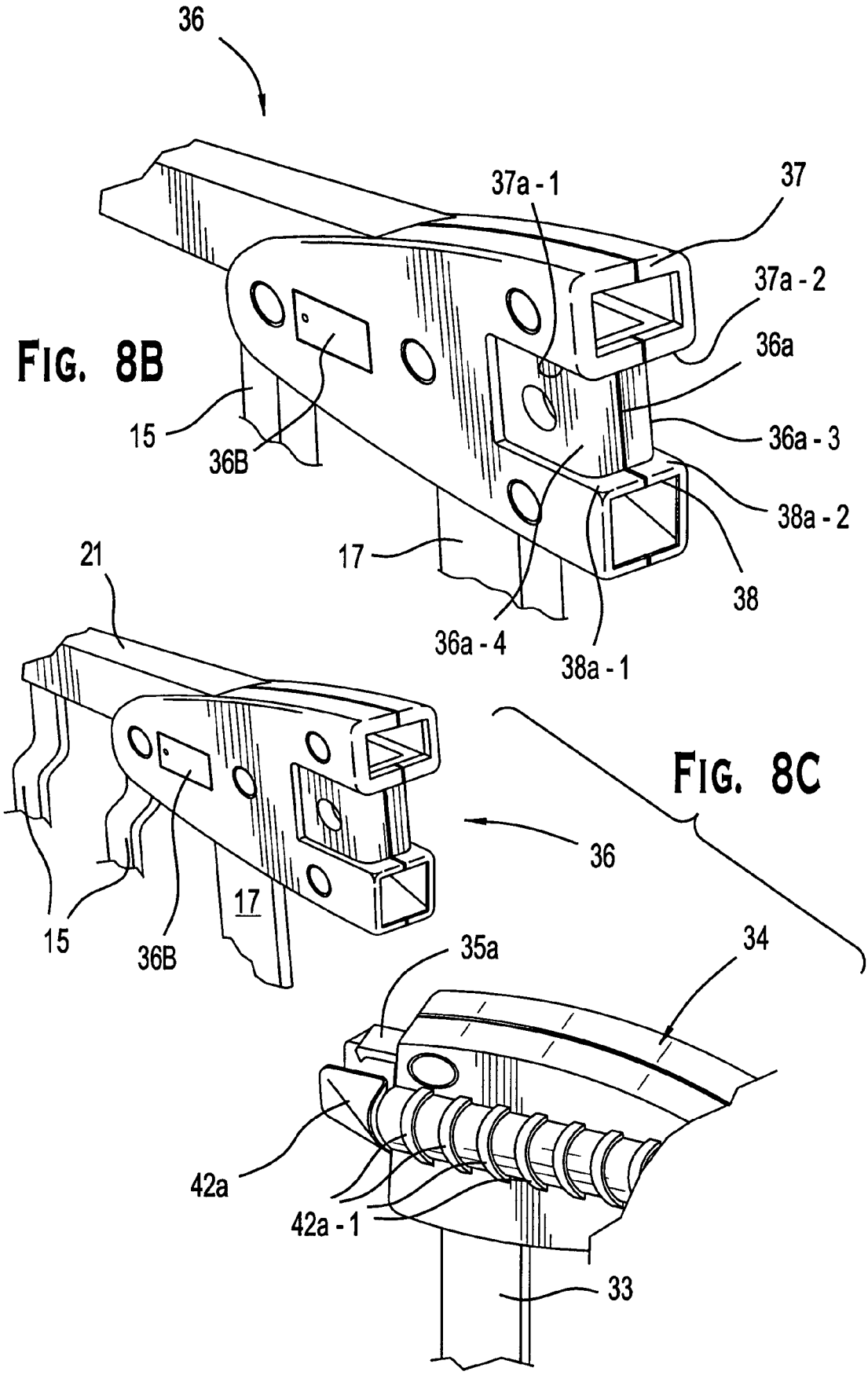
FIGS. 8B-8D are perspective views of details of a latching mechanism.
Figure 8D:
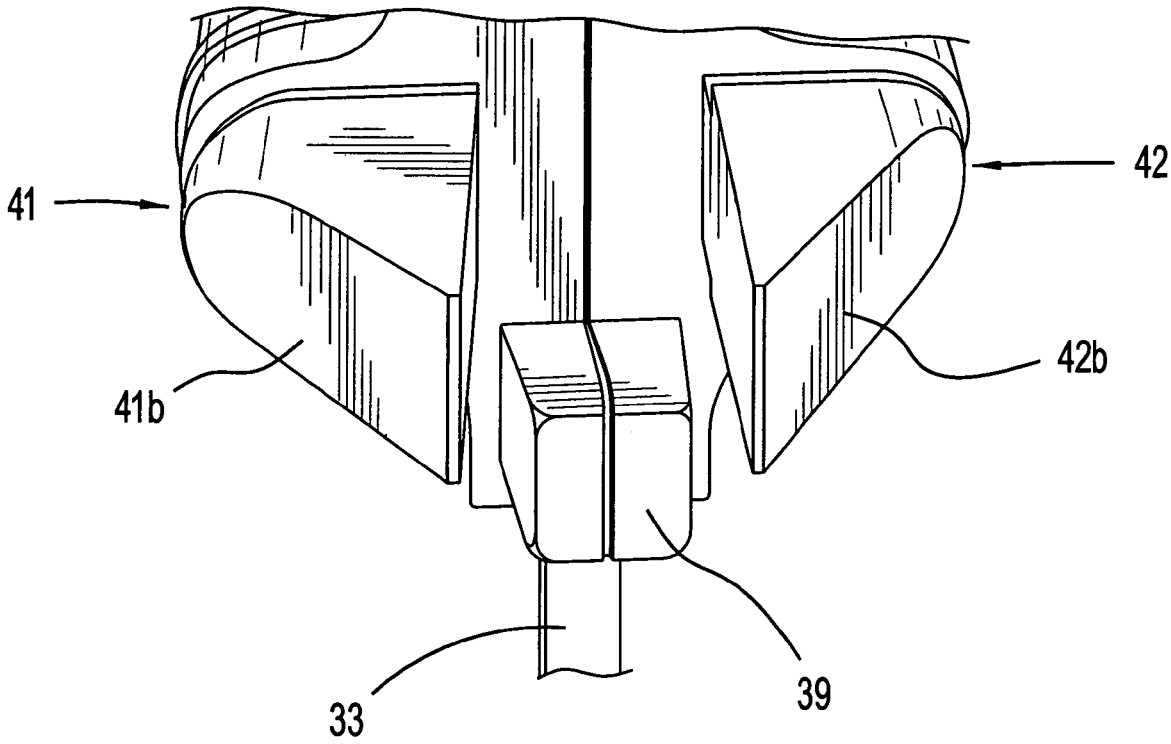

A latching mechanism arranged for slidable movement along gate 30 is provided within housing 34 and encloses a pivotally mounted locking arm 35 having a hook-shaped projection 35*a* at one end for cooperation with a fixed locking member 37 provided within housing 36. Housing 36 is fixedly secured to post 17 and top rail 21. Housing 36 is further provided with a recess 38 for receiving a movable, spring biased projection 39 arranged within housing 34. The manner in which the latching mechanism operates is as follows, making reference to FIGS. 2, 4-4B and 8-8D:

FIGS. 4, 8 and 8*a* show the latching mechanism in the latched position. When it is desired to unlatch the gate, the operating portion 35*b* of locking arm 35, which extends upwardly through an opening 34*a* in housing 34, is pressed downwardly against spring SP1 as shown by arrow A, whereby the locking arm 35 rotates counter-clockwise about pivot pin 35*c*, as shown by arrow B, to be free of fixed locking number 35. While maintaining the operating lever portion 35*b* pressed downwardly against the force of spring SP1, the housing 34*b* of the assembly 34 is preferably grasped by the hand pressing down lever 35*b* and is pulled to the left as shown by arrow C in FIGS. 4 and 8. The convex shaped sides of members 41 and 42 (see FIGS. 4A, 4B, 8A, 8B and 8C) are provided with a plurality of arcuate shaped gripping projections 42*a*-1, 42*b*-1 which act to facilitate a firm grip in order to more easily pull housing 34 away from housing 36. This causes the assembly 34 to slide to the left, withdrawing locking lever 35, which is now in the dotted position 35' (FIG. 4), outwardly from the housing 36. The locking portion of lever 35 is now in the dotted position 35*a*' and is clear of the stationary locking arm 37, enabling the locking lever 35' to be freely moved out of the housing 36. The projection 39, which is fixedly secured to housing 34*b*, is also moved to the left with the movement of housing 34 so as to be displaced from the recess 38 in housing 36.

In addition, the tapered projections 41, 42, which are an integral part of housing 34 and likewise move with the housing 34, are moved to the left as shown by arrow C so that their free ends 41*a*, 42*a*, when moved to the dotted positions 41*a*', 42*a*', are clear of the sides 36*a*-1 and 36*a*-2 adjacent to recess 36*a* in housing 36, enabling the gate 30 to be opened. It should be understood that gate 30 may be rotated in either direction about the hinge assemblies 27 and 28, the direction in which the gate 30 is moved thus being capable of being dictated by the particular environment in which the gate is used. The arrows E and F in FIG. 1 show the opposing directions in which the gate 30 may be selectively moved. The spring assembly of FIGS. 7*a*-7*c* moves the gate toward the closed position when the gate is released.

Once the latching mechanism in housing 34 is clear of the cooperating latching mechanism in housing 36, the housing portion 34*b* and operating member 35*b* may be released, causing the latching arm 35 to return to the solid-line position. An inverted, L-shaped stop member S limits further movement of the latching arm 35 beyond the solid-line position shown in FIG. 4. In addition thereto, the members 35, 39, 41, and 42 are moved to the right, i.e. in the direction opposite that of arrow C, shown in FIGS. 4 and 8, under the force of compressed spring SP2.

When the gate is in the open position and is released, the closing springs provided within at least one of the hinge assemblies 27 and/or 28 return the gate to the closed position.

Figure 4B:
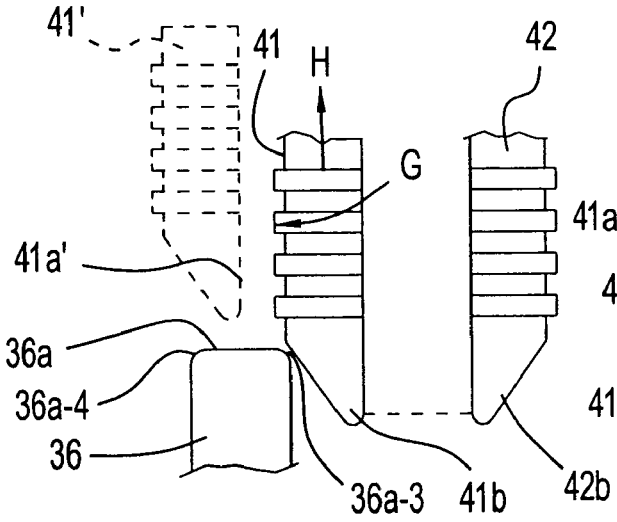
FIGS. 4A and 4B illustrates a portion of the latching mechanism in the closed and closing positions.
Figure 4A:
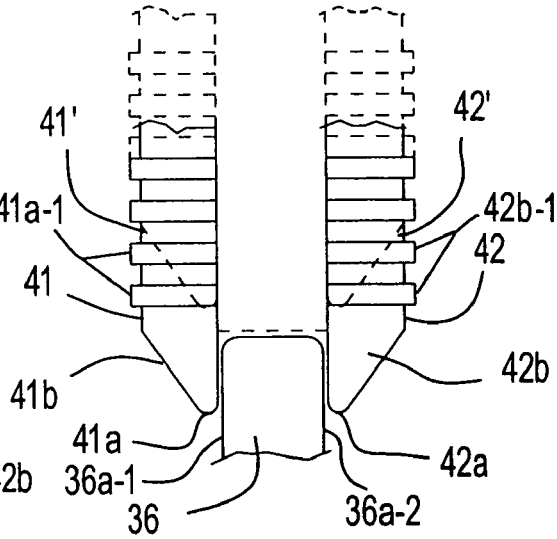

In moving toward the closed position, the tapered side of one of the projections 41 and 42 slideably engages an adjacent, vertically aligned vertex 36*a*-3 (or 36*a*-4) of the recess 36*a*. The tapered guide surfaces of projections 41 and 42 cooperate with the cooperating surfaces 38*a*-1, 38*a*-2 and 37*a*-1, 37*a*-2 to assure proper orientation of the housings 34, 36 to assure that they are aligned and at the correct height. This sliding engagement, as the gate is swung along a curved path G shown in FIG. 4*b*, causes the projection 41 and hence housing 34, to be urged in the direction of arrow H, thereby moving the locking lever 35 and projection 39 away from the cooperating stationary latching assembly 36. FIG. 4*b* shows the projection 41' in dotted fashion after it has been moved in the direction of arrow H so that its tip 41*a*' is clear of the projection 36*a* allowing the gate to swing open, as shown in FIG. 2.

To close and latch the gate, it is moved to bring one of the tapered projections into engagement with projection 36*a*. Initially, tapered portion 41*b* engages edge 36*a*-3 of projection 36*a*, causing the projection 41 to be moved in the direction of arrow H as the gate moves to the left in FIG. 4B, until the projection 41*b* rests on the surface of recess 36*a*. Eventually, projection 41' passes the left edge 36*a*-4 of surface 36*a*, at which time both projections 41 and 42 snap into the solid-line position shown in FIGS. 4 and 8 under the force of spring SP2. Projection 39 enters into recess 38 while the tapered cam surface 35*d* of latching arm 35 slideably engages the top surface 37*a* of stationary latching member 37 causing the latching arm 35 to move toward the dotted-line position 35', shown in FIG. 4.

As soon as the tip 35*a* of the latching arm 35 is clear of the top surface 37*b* of stationary latching member 37, latching arm 35 swings downwardly under the force of biasing spring SP1 into the locking position shown in FIG. 4, which is the solid-line position of latching arm 35.

It should be understood that the projection 42 functions in substantially the same manner when its tapered surface 42*b* engages the left-hand vertex of surface 36*a* shown in FIG. 4*b*.

Figure 5:
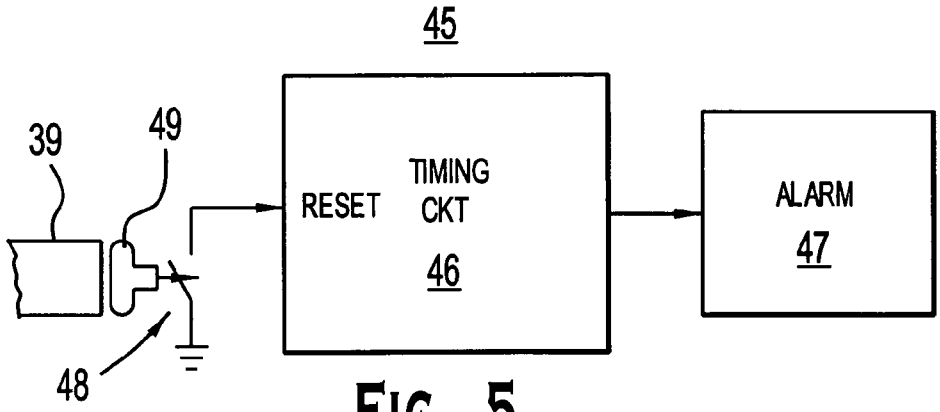
FIG. 5 is a block diagram of a timer/alarm which may be employed in embodiments of present invention.
Figure 6A:
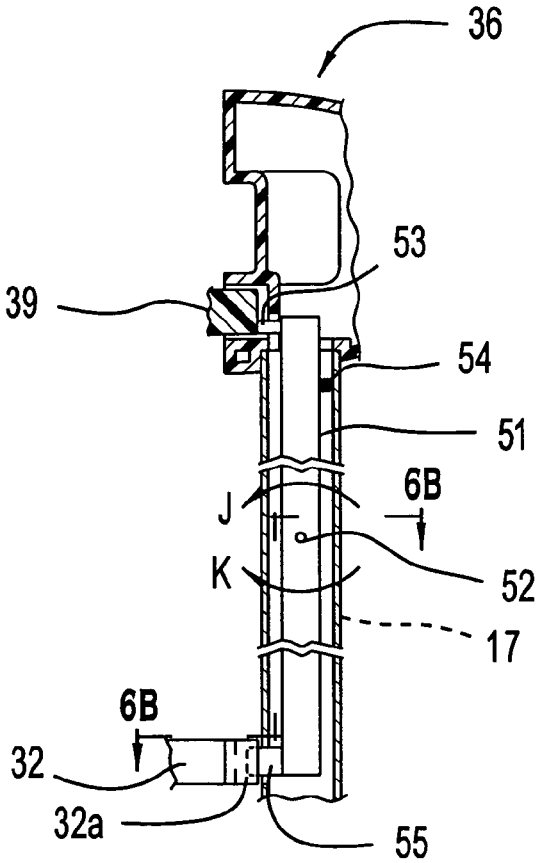
FIG. 6A is an elevational view of a locking mechanism for the lower end of the safety gate according to the invention.
Figure 6B:
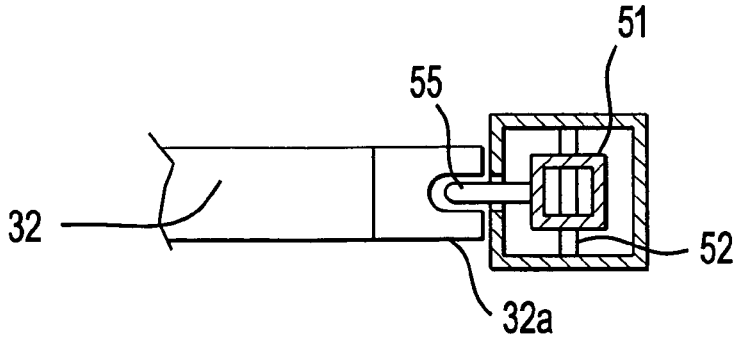
FIG. 6B is a view of a cooperating locking pin and recess looking in the direction of arrows 6B-6B in FIG. 6A.
Figure 7A:
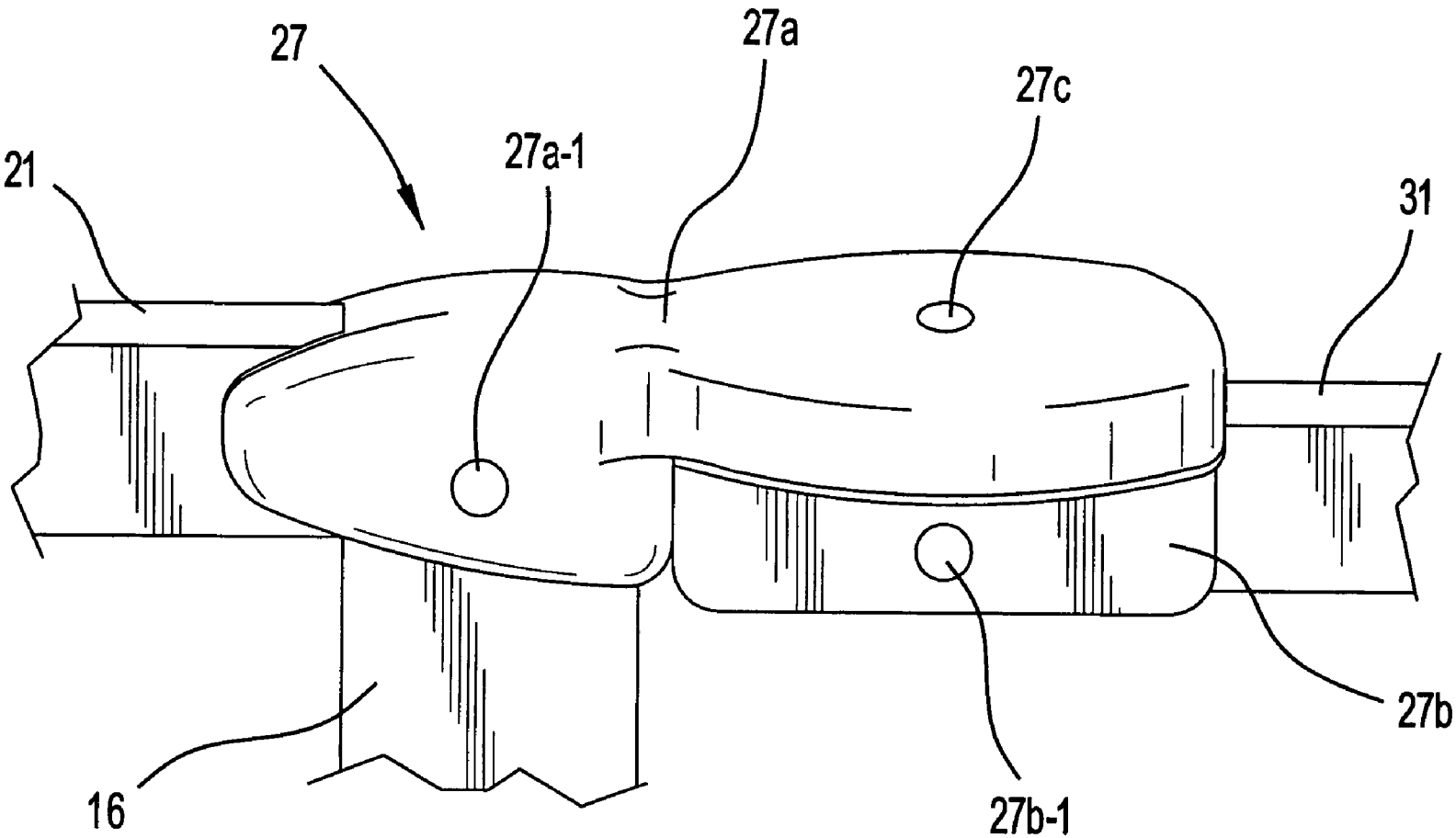
FIGS. 7A-7C are perspective, plan and perspective views showing a hinge assembly for the present invention assembled and disassembled.
Figure 7B:
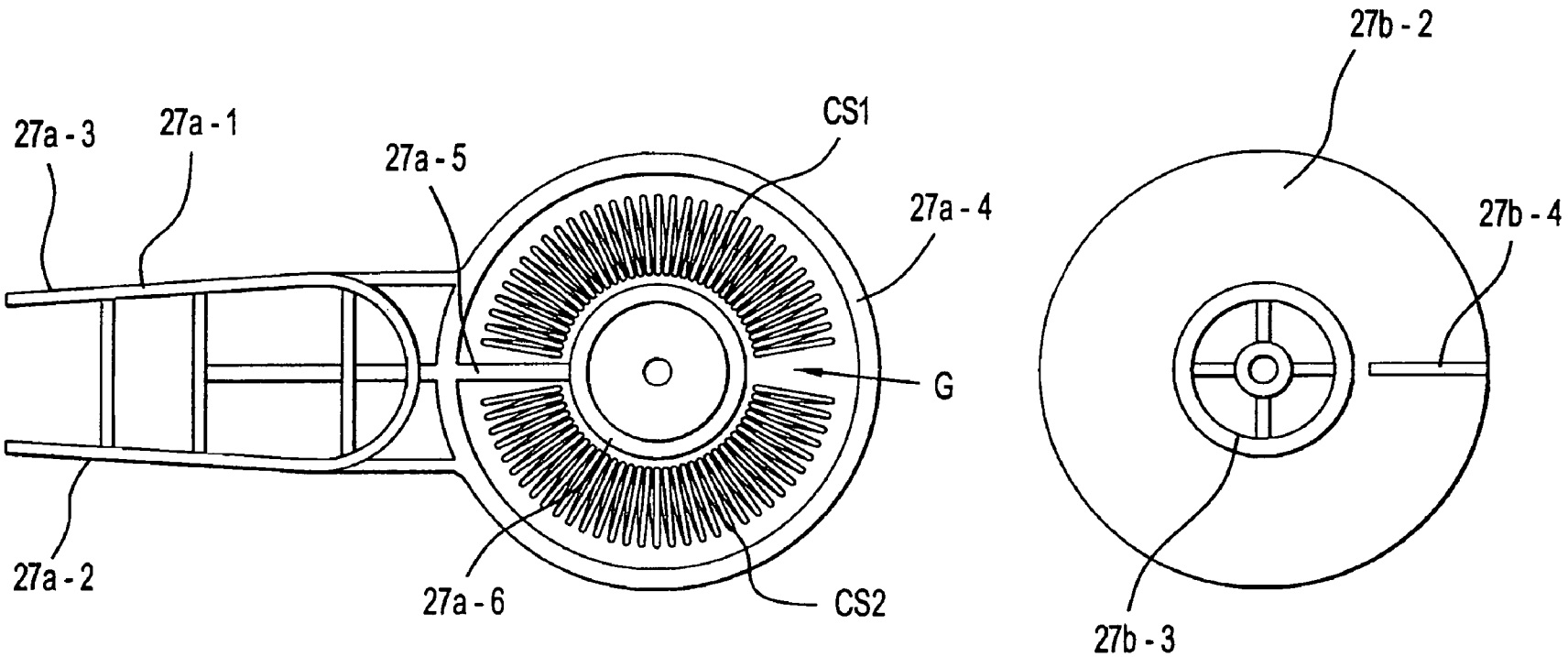
Figure 7C:
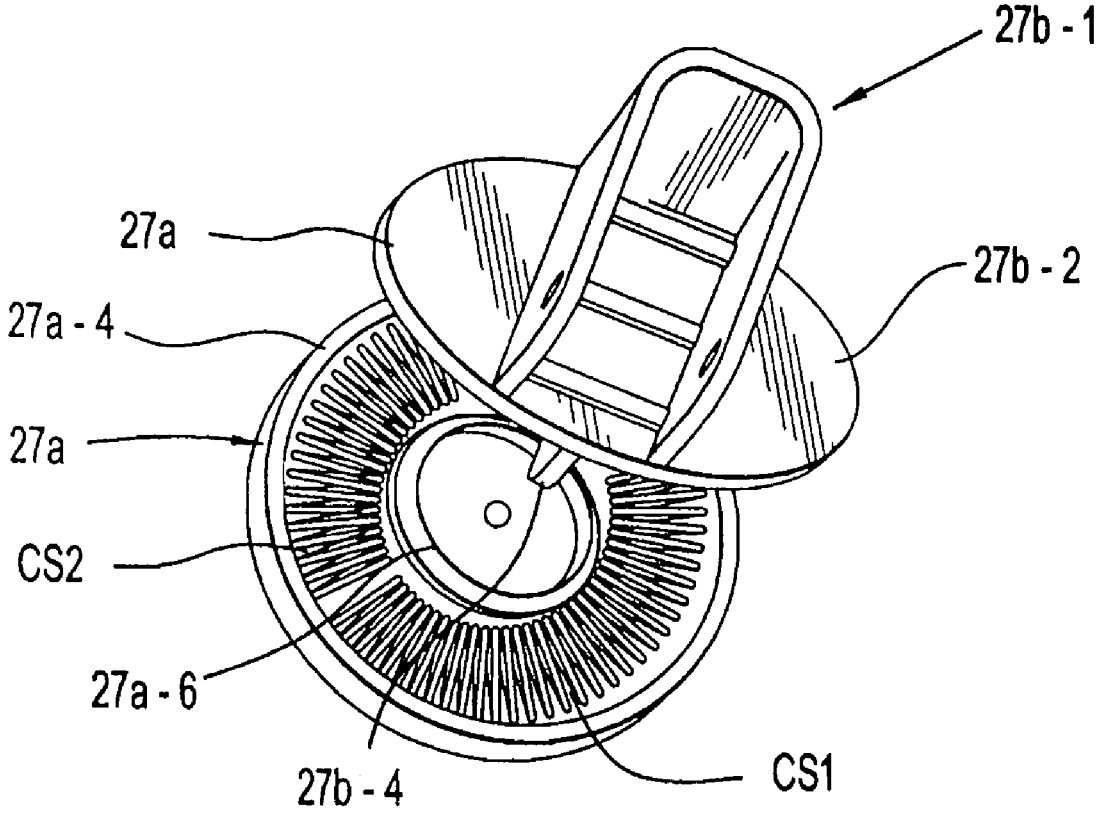

FIG. 5 shows a timing device 45 housed within the stationary latching assembly housing 36 (See FIG. 8) and is comprised of a timing circuit 46 which operates an alarm 47. A battery compartment, indicated at 36B of FIGS. 8B and 8C, houses an energy source which powers the timing circuit/alarm. A normally-open switch 48 is coupled to a reset input of the timing circuit. The timing circuit operates such that when normally-open switch 48 remains closed, the closed switch 48 repeatedly resets the timing circuit preventing it from timing out. Alternatively, the switch may be a normally-closed switch. The closing of switch 48 may be accomplished in the present invention by projection 39 which, when inserted into recess 38, presses against a pin 49 normally biased so as to be displaced from the normally-open switch 48. When projection 39 enters into recess 38, it presses against pin 49 which closes the normally-open switch 48, preventing the timing circuit 46 from timing out and hence preventing the alarm 47 from operating. When the projection 39 is withdrawn from recess 38, the timing circuit 46 is activated. A predetermined time interval after activation, timing circuit 46 times out, causing alarm 47 to operate. Alarm 47 may be an audible alarm, a visual alarm, or a combination audio/visual alarm. The audible alarm may for example be a buzzer and the visual alarm may be a blinking light of a suitable color (red, for example). The timing circuit is adjustable to accommodate a desired time delay. One suitable time delay is a seven second time delay whereby, if the gate is not returned to the closed and latched position within seven seconds from the time that it is opened, the alarm will operate. Obviously other delay periods may be selected dependent upon the particular application.

In addition thereto, the timing circuit may be activated in any other suitable manner. For example, the housing 34 may be provided with a permanent magnet that is positioned in close proximity to the operating switch 48 when the gate is closed, switch 48 may have a magnetically attractive member drawn to the permanent magnet when the gate is in the closed position and released from the magnet field of the permanent magnet when the gate is opened, thereby enabling the timing device to time out. Obviously, any other form of activating mechanism may be employed. As another example, the normally-open switch 48 may be a light sensor which is covered by the moveable latching assembly 34 when the gate is in the closed position to prevent ambient light from reaching the light sensor thereby preventing the timing circuit 46 from timing out. When the gate is open, ambient light is free to reach the sensor initiating a timing interval of the timing circuit which, when the timing circuit times out, causes the alarm to be initiated.

The normally-open switch 48 may be an LED and sensor which senses light from the LED reflected from a cooperating reflective surface of the moveable latching assembly when the gate is in the closed position to thereby prevent the timing circuit from timing out. When the gate is open, no light is reflected from the LED to the light sensor enabling the timing circuit to time out and operate the alarm after a predetermined delay interval.

The timing circuit 46, alarm 47 and, in the case of a light sensor or LED/light sensor, are powered by a suitable energy source in compartment 36B of the stationary latching mechanism housing 36. Alternatively, the timing circuit/alarm may be housed in the gate, if desired although it is preferable to mount the timing circuit/alarm on the stationary frame.

In addition to latching the upper end of gate 31 to the upper end of frame 12, the latching mechanism is further provided with an elongated rod 51 arranged within hollow post 17 and pivotally mounted thereto by a pin 52. The upper end of rod 51 is provided with a projection 53 engaged by projection 39 when the gate is in the locked position. A spring 54 normally biases rod 51 toward rotation in the counter-clockwise direction about pivot pin 52, as shown by arrow J. When projection 39 enters into recess 38, projection 39 engages projection 53 on rod 51 urging the rod 51 to rotate clockwise about pin 52 and against the force of spring 54, as shown by arrow K. The lower end of rod 51 is provided with a projection 55 which enters into a U-shaped recess provided at the free end 32*a* of the lower rail 32 of gate 30 thereby locking the gate 30 at both the upper and lower ends to the stationary frame 12.

Figure 2A:
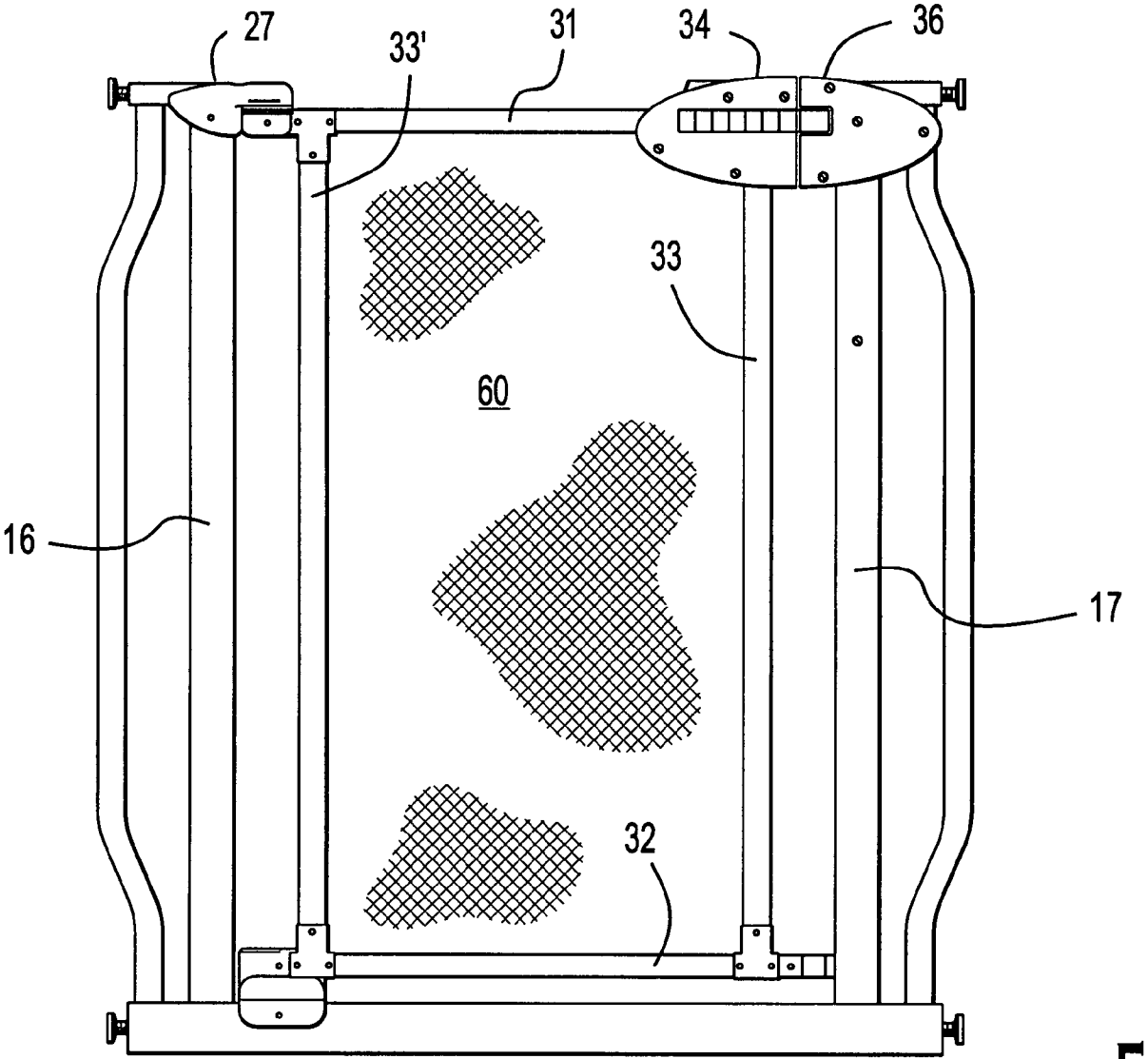
FIG. 2A is a perspective view of another embodiment of the safety gate shown in the closed position.
Figure 3:
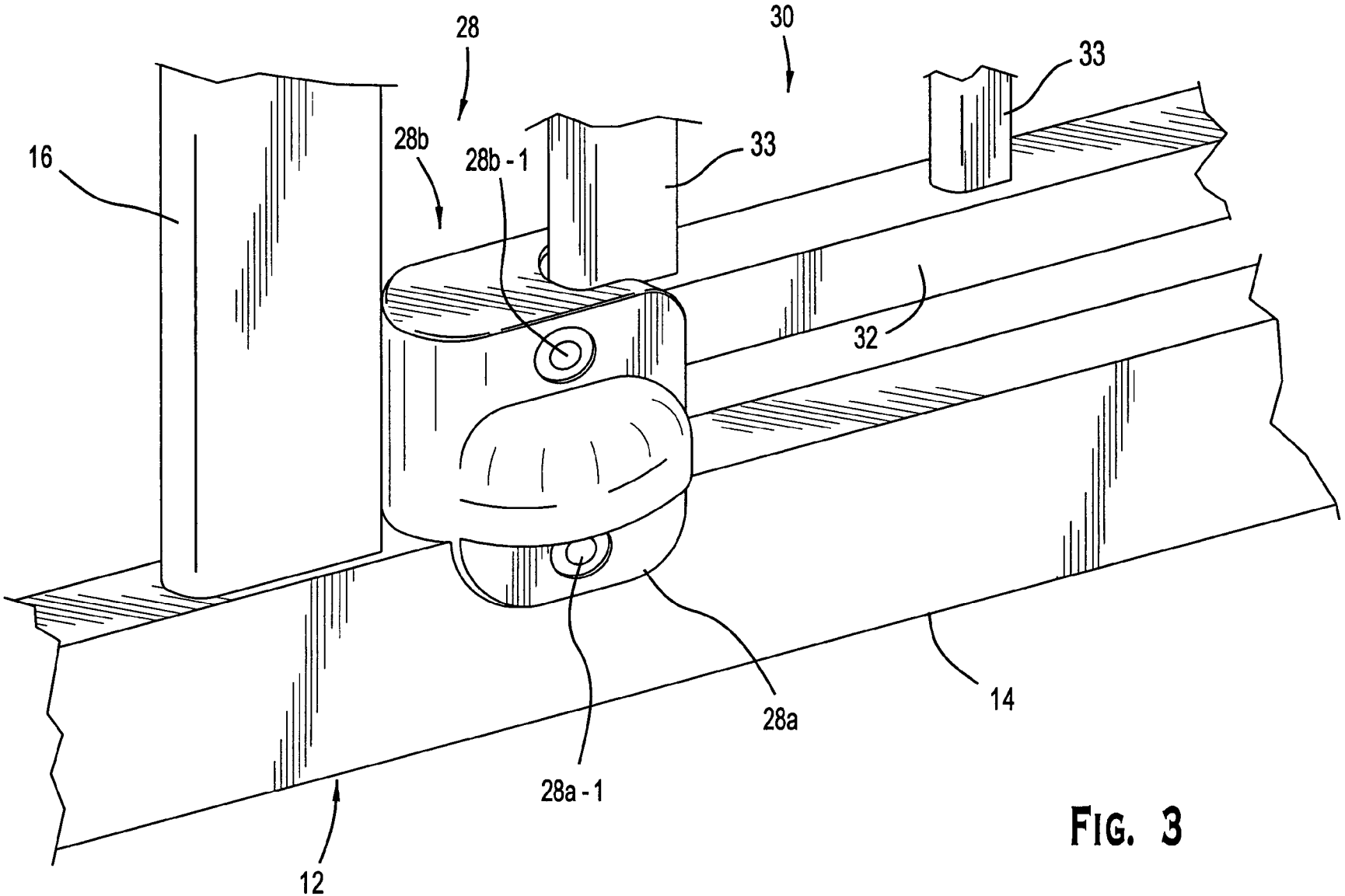
FIG. 3 is a perspective view of the lower hinge assembly.

Whereas FIG. 1 shows gate 30 as comprised of vertically aligned spaced members 33 secured to upper and lower rails 31 and 32, FIG. 2*a* shows an alternative embodiment in which the inner-most members 33 of the gate are removed and replaced with a rugged mesh sheet 60 secured along its entire perimeter to a frame comprised of the vertical sides 33, 33' and the top and bottom rails 31 and 32.

The invention claimed is:

1. A safety gate comprising:

a stationary frame having adjustment means, to selectively close an opening by abutting a structure defining the opening, and an opening defined within the stationary frame;

a gate movably mounted within said stationary frame opening;

a latching mechanism comprising a first housing having a movable latching member movable relative to said first housing and extending through an opening in said first housing, said first housing being movably mounted on said gate, said movable latching member selectively engaging a fixed latching member provided in a second housing arranged along said frame opening when said gate is in a closed position; and an operating lever pivotally mounted to said second housing and projecting from said first housing for moving the movable latching member away from said fixed member when the operating lever is pressed in a first direction;

said movable first housing being movable between a latched and an unlatched position and having a projecting portion;

said fixed latching member being adjacent to a recess in said second housing;

wherein said projecting portion is positioned in said recess and said movable latching member engages said fixed latching member when the gate is closed and latched and said projecting portion is withdrawn from said recess when the gate is in the closed position and the movable latching member is displaced from the fixed latching member, enabling the movable housing portion to move to the unlatched position.

2. The safety gate of claim 1 wherein the movable housing has a gripping surface positioned adjacent to the operating lever to enable both the gripping surface and operating lever to be operated substantially simultaneously by using only one of an operator's hands to move the operating lever and move the projection out of said recess.

3. The safety gate of claim 1 wherein said movable latching member has a projection for selective locking engagement with said fixed latching member which is comprised of a stationary projection.

4. The safety gate of claim 3 wherein said movable latching member has a cam surface slidably engaging the fixed latching member to move a latching edge of the movable latching member in a direction away from a cooperating surface of the fixed latching member as the first latching member moves into said recess.

5. The safety gate of claim 1 further comprising a locking pin moveable between an unlocked and locked position;

said locking pin being mounted near a lower end of a connecting rod pivotally mounted in said frame which swings the locking pin to the locked position extending into a locking recess provided near a lower end of said gate when an upper end of said rod is engaged by an actuating member of said latching mechanism housing, which actuating member is mounted on said gate.

6. The safety gate of claim 5 wherein said frame further comprises a hollow post, said connecting rod being arranged within said hollow post and pivotally mounted to said post at a location along the post.

7. The safety gate of claim 5 wherein said connecting rod is normally biased to urge the locking pin toward the unlocked position.

8. The safety gate of claim 7 wherein said movable latching member is normally urged in a direction toward the latched position by bias means.

9. The safety gate of claim 8 wherein said movable latching member is provided with a cam surface which slideably engages said fixed latching member when the first latching member is moved toward said second latching member to move a latching surface of the first latching member away from the second latching member, said movement away from the second latching member being terminated when said cam surface clears said second latching member wherein the latching surface of the first latching member is moved toward said latching position by said bias means.

10. A safety gate comprising:

a gate;

a stationary frame arranged to selectively close off an access opening positioned between two (2) adjacent areas, said opening being defined by at least a floor and two (2) spaced side surfaces;

said frame being secured between said sides by holding members on opposite sides of said frame;

said frame having an opening for receiving said gate, one side of said gate being moveably mounted to one side of said frame opening;

a latching mechanism arranged along another side of said gate opposite said one side and having a first and second movably mounted members movable between a latched and unlatched position and being normally urged in a first direction outwardly and away from said gate by bias means;

a fixed latching member fixed on said frame;

said first and second movable members being spaced apart and each having a cam surface for slideably engaging one of a pair of opposing vertices of said fixed member when said gate is swung toward a position in alignment with said fixed member, one of said cam surfaces slidably engaging an associated vertex and being moved toward the unlatched position until said one cam surface engaging said associated vertex is free of said associated vertex whereupon the first and second movable members are both urged to the latched position whereby said first and second movable members lie on opposite sides of said fixed member, said fixed member being positioned between said first and second movable members when the gate is in a closed position.

11. The safety gate of claim 10 wherein said gate may be opened when said first and second movable members are moved to the unlatched position.

12. The safety gate of claim 10 wherein said first and second movable members are coupled so as to move in unison.

13. The safety gate of claim 1 further comprising:

a timing device for emitting an alarm a given time after being activated;

said timing device being disabled when the gate is closed in the latching mechanism is latched and being enabled to time out when said latching mechanism is unlatched.

14. A safety gate comprising:

a gate;

a stationary frame arranged to selectively close off an access opening positioned between two (2) adjacent areas, said opening being defined by at least a floor and two (2) spaced side surfaces;

said frame being secured between said side surfaces by adjustable holding members on opposite sides of said frame;

said frame having a gate opening for receiving said gate, one side of said gate opening having hinge assemblies for moveably mounting one side of said gate to said frame;

a latching mechanism arranged along another side of said gate opposite said one side for selectively engaging a fixed latching member arranged along said frame when said gate is in a closed position;

at least one of said hinge assemblies comprising a housing, and a helical biasing spring maintained in a toroidal shape in said housing and cooperating with a projection moved by said gate, which compresses a portion of the spring when the gate is opened for normally urging said gate toward the closed position.

15. The safety gate of claim 14 wherein the housing of said one of said hinge assemblies comprises first and second housing halves pivotally coupled to one another and respectively mounted to said one side of said opening and said one side of said gate;

said housing halves cooperating to form a hollow enclosed space for housing said biasing assembly;

said one hinge assembly enabling said gate to selectively swing about pivot of said hinge assembly in either a clockwise or counter clockwise direction from a closed position;

said biasing assembly urging said gate toward said closed position regardless of movement of said gate in either direction away from the closed position.

16. The safety gate of claim 15 wherein said hollow enclosed space is toroidal-shaped;

said biasing assembly comprising first and second helical springs mounted in said toroidal-shaped enclosed space;

one end of said first and second springs engaging an integral projection in one of said housing halves;

remaining ends of said first and second springs engaging an integral projection in another one of said housing halves, whereby one of said springs is compressed when said gate is moved in a given one of said clockwise and counter-clockwise directions, said compressed spring urging said gate toward the closed portion when the gate is released.

17. The safety gate of claim 15 wherein one of said housing halves is cup-shaped and a remaining one of said housing halves is disc-shaped;

both of said housing halves having centrally located cylindrical projections being telescoped into one another to provide a pivotal coupling therebetween, said housing halves when coupled together, forming a toroidal-shaped hollow region for retaining said biasing assembly comprising a helical spring in a circular configuration;

an integral projection in one of said cup-shaped and disk-shaped members respectively engaging free ends of said spring and an integral projection in a remaining one of said cup-shaped and disk-shaped members projecting into an intermediate turn of said spring.

18. The safety gate of claim 15 wherein one of said housing halves is cup-shaped and a remaining one of said housing halves is disc-shaped;

both of said housing halves having centrally located cylindrical projections being telescoped into one another to provide a pivotal coupling there between, said housing halves when coupled together, forming a toroidal-shaped hollow region for retaining said biasing assembly comprising a pair of helical springs in a circular configuration;

an integral projection in one of said cup-shaped and disk-shaped members respectively engaging first ends of said springs and an integral projection in a remaining one of said cup-shaped and disk-shaped members engaging second ends of said springs.

19. A gate assembly comprising:

a stationary frame to selectively close off a frame receiving opening defined by a structure and defining a gate receiving opening that is smaller than said frame receiving opening;

a gate mounted in said gate receiving opening; and a latching mechanism comprising:

i) a housing, which is slidably mounted on and movable along said gate;

ii) a movable latching member pivotally mounted in said housing for selective engagement with a fixed latching member arranged on said stationary frame; and iii) an operating lever projecting from said housing for moving the movable latching member away from the fixed member when the operating lever is pressed in a first direction;

wherein said movable latching member extends into a recess in said fixed latching member and engages said fixed latching member when the gate is closed and latched and is withdrawn from said recess and displaced from the fixed latching member when the movable housing is moved to an unlatched position.

* * * * *